US006153557A

United States Patent [19]

Nakanishi

[11] Patent Number: 6,153,557

[45] Date of Patent: Nov. 28, 2000

[54] STICKER, METHOD OF PRODUCING THE SAME, AND STICKER PRINTING METHOD

[75] Inventor: Kanji Nakanishi, Saitama, Japan

[73] Assignee: Fuji Photo Film Co., Ltd., Kanagawa, Japan

[21] Appl. No.: 09/189,937

[22] Filed: Nov. 12, 1998

[30] Foreign Application Priority Data

Nov. 13, 1997 [JP] Japan ..... 9-311787

[51] Int. Cl.[7] ..... B41M 5/20

[52] U.S. Cl. ..... 503/201; 156/252; 283/81; 427/152; 428/42.2; 428/43; 503/200; 503/226; 503/227

[58] Field of Search ..... 347/221; 503/227, 503/200, 201, 226; 8/471; 156/252; 283/81; 427/152; 428/42.2, 43

[56] References Cited

U.S. PATENT DOCUMENTS 4,734,704 3/1988 Mizutani et al. ..... 346/76 PH

FOREIGN PATENT DOCUMENTS 61-213169 of 0000 Japan .

*Primary Examiner*—Bruce Hess

*Attorney, Agent, or Firm*—Sughrue, Mion, Zinn, Macpeak & Seas, PLLC

[57] ABSTRACT

A sticker sheet includes support paper. An obverse and a reverse laminate layers are disposed on respectively surfaces of the support paper. Three thermosensitive coloring layers are disposed on the obverse laminate layer, constitute a recording medium with the support paper, and adapted to direct thermal recording. An adhesive layer is disposed on the reverse laminate layer. Release paper is secured to the recording medium by the adhesive layer in a peelable manner. Cut lines are formed in the recording medium by cutting the reverse laminate layer and the support paper with the coloring layers and the obverse laminate layer kept uncut at least partially, and partition the recording medium into plural sticker chips. After the thermal recording, the coloring layers and the obverse laminate layer are tearable along the cut lines, and the sticker chips are separable with the adhesive layer.

13 Claims, 10 Drawing Sheets

STICKER, METHOD OF PRODUCING THE SAME, AND STICKER PRINTING METHOD

BACKGROUND OF THE INVENTION

1. Field of the Invention

The present invention relates to a sticker, a method of producing the same, and a sticker printing method. More particularly, the present invention relates to a sticker having a first surface as a medium of digital hard copy and a second surface operating as an adhesive surface, a method of producing the same, and a sticker printing method in which the sticker is used.

2. Description Related to the Prior Art

There is an automatic portrait producing machine with a trade name of "Print Club" recently popular to teenagers. The machine has a height sightly greater than an average height of human beings, and incorporates a pick-up device, a display and a color printer. When a client stands in front of the machine and inserts coins, his or her human face is picked up and indicated by the display. Then he or she selects one of preset designs for the background of a frame, and then pushes a print button. Finally a combined image including the human face and the background design is printed on sticker material.

The term "sticker material" is herein used to represent a sheet material which has a recording surface and a back surface, and in which the recording surface is adapted to record an image according to image data of an object being picked up, and the back surface is provided with adhesive agent for the purpose of easily enjoying the digital hard copy of the image.

A sticker sheet has an adhesive layer with which the back surface of the recording medium is coated. Release paper is placed on the adhesive layer in a peelable manner. In FIG. 13, a sticker sheet 2 has cut lines 3 each of which is rectangularly shaped. The sticker sheet 2 is partitioned by the cut lines 3 into the a plurality of sticker chips 4. The sticker chips 4 have a size of 17×23 mm, and are arranged in a matrix.

A common combined image is equally recorded to any of the sticker chips 4. After the printing the sticker chips 4 are peeled along the cut lines 3. As the sticker chips 4 have adhesive layer disposed on the back surface, the sticker chips 4 can be attached to a notebook or the like very easily.

There are various types of full-color printing, including a sublimation type of thermal transfer recording method, and a direct thermal recording method disclosed in U.S. Pat. No. 4,734,704 (corresponding to JP-A 61-213169). In the thermal transfer recording method, a thermal transfer recording sheet is used. Ink ribbon is overlaid on the thermal transfer recording sheet. A thermal head applies heat to the rear of the ink ribbon, to transfer dye of the ink ribbon to a dye receiving layer of the recording sheet. In the direct thermal recording method, a thermosensitive recording sheet is used. A thermal head applies heat to the recording sheet to develop colors for recording an image.

FIG. 10 illustrates a layered structure of a sticker sheet 5 of a thermosensitive recording material. A thermosensitive recording sheet 11 is constituted by a support 6 and coloring layers 10 disposed to overlie thereon. The support 6 is constituted by support paper 7 and laminate layers 8 and 9 disposed on respective surfaces of the support paper 7. The coloring layers 10 are disposed on the obverse laminate layer 8. Release paper 13 is adhered to the reverse laminate layer 9 of the support 6 by use of adhesive layer 12. There are cut lines 14 cut through a range from the coloring layers 10 to the adhesive layer 12, to divide the recording sheet 11 into sticker chips.

If the recording is monochromatic, the sticker sheet 5 has only one thermosensitive coloring layer. For full-color recording, the coloring layers 10 include yellow, magenta and cyan thermosensitive coloring layers in sequence toward the support paper. To color the coloring layers selectively, the coloring layers are different in sensitivity to heat. The cyan coloring layer lying in the deepest position has the lowest sensitivity and requires the highest heat energy for developing certain color density. The yellow coloring layer lying in the least deep position has the highest sensitivity and requires the lowest heat energy for developing certain color density. The yellow and magenta coloring layers are provided with optical fixability to ultraviolet rays. For the full-color recording, each heated coloring layer directly overlying on a coloring layer as a present target must be prevented from being colored again. Thus the yellow and magenta coloring layers are fixed with ultraviolet rays of predetermined wavelength ranges for destroying coloring ability.

FIG. 11 illustrates a layered structure of a sticker sheet of a sublimation type of thermal transfer recording material. A thermal transfer recording sheet 19 is constituted by a support 15 and a dye receiving layer 18 disposed to overlie thereon. The support 15 is constituted by support paper 16 and a reverse laminate layer 17 disposed on a back surface of the support paper 16. Release paper 21 is adhered to the reverse laminate layer 17 of the support 15 by use of adhesive layer 20. There are cut lines 22 cut through a range from the dye receiving layer 18 to the adhesive layer 20, to divide the thermal transfer recording sheet 19 into sticker chips.

The sticker sheet is passed between the thermal head and a platen roller in the course of printing. In FIG. 12, a heating element array 26 of a thermal head 25 is offset from a center of a platen roller 27. When a portion where some of the cut lines are aligned is conveyed past the platen roller 27, the sticker sheet 5 is likely to be pressed toward the release paper. Then the cut lines 14 are likely to bend and open in the position of the broken line A of FIG. 13. The rigidity of the sticker sheet 5 changes, to change the pressing force of the heating element array 26. There occurs irregularity in density in an image printed on the sticker chips 4.

During the conveyance for printing, the sticker sheet is likely to bend in a direction toward the release paper. The cut lines are likely to be rubbed. It is likely that the sticker chips are incidentally peeled without intention.

SUMMARY OF THE INVENTION

In view of the foregoing problems, an object of the present invention is to provide a sticker material in which occurrence of irregularities in density is avoided in a printed image because of influence of cut lines to rigidity, and a method of producing the same, and a sticker printing method.

Another object of the present invention is to provide a sticker material in which unwanted peeling of sticker chips in the course of printing is prevented, and a method of producing the same, and a sticker printing method.

In order to achieve the above and other objects and advantages of this invention, a sticker material includes support paper. An obverse and a reverse laminate layers are disposed on respectively surfaces of the support paper. At least one thermosensitive coloring layer is disposed on the obverse laminate layer, for constituting a recording medium with the support paper, the coloring layer being adapted to direct thermal recording. An adhesive layer is disposed on the reverse laminate layer. Release paper is secured to the recording medium by the adhesive layer in a peelable manner. A cut line is formed in the recording medium by cutting the reverse laminate layer and the support paper with the coloring layer and the obverse laminate layer kept uncut at least partially, for partitioning the recording medium into plural sticker chips, wherein after the thermal recording, the coloring layer and the obverse laminate layer are tearable along the cut line, and the sticker chips are separable with the adhesive layer.

In a preferred embodiment, the plural sticker chips are substantially rectangular, and arranged in a matrix in the recording medium.

The at least one coloring layer is plural coloring layers overlaid on one another, the coloring layers have heat sensitivity decreasing in sequence toward the support paper, and are supplied serially with first to Nth heat energy, for the thermal recording in a frame-sequential manner layer after layer toward the support paper. Part of the obverse laminate layer along the cut line is broken by the Nth heat energy.

The obverse laminate layer is formed of thermoplastic resin.

The thermoplastic resin is low-density polyethylene.

In another preferred sticker material, there is support paper. An obverse and a reverse laminate layers are disposed on respectively surfaces of the support paper. A dye receiving layer is disposed on the obverse laminate layer, for constituting a recording medium with the support paper, the dye receiving layer being adapted to thermal transfer recording. An adhesive layer is disposed on the reverse laminate layer. Release paper is secured to the recording medium by the adhesive layer in a peelable manner. A cut line is formed in the recording medium by cutting the reverse laminate layer and the support paper with the dye receiving layer and the obverse laminate layer kept uncut at least partially, for partitioning the recording medium into plural sticker chips, wherein after the thermal transfer recording, the dye receiving layer and the obverse laminate layer are tearable along the cut line, and the sticker chips are separable with the adhesive layer.

To produce a sticker material, surfaces of support paper are coated with respectively an obverse and a reverse laminate layers. The obverse laminate layer is coated with at least one thermosensitive coloring layer or a dye receiving layer, to obtain a recording medium, the coloring layer being adapted to direct thermal recording, and the dye receiving layer being adapted to thermal transfer recording. A cut line is formed by cutting the reverse laminate layer and the support paper with the obverse laminate layer kept uncut at least partially, for partitioning the recording medium into plural sticker chips. The reverse laminate layer is coated with an adhesive layer. Release paper is secured to the recording medium by the adhesive layer in a peelable manner, to obtain the sticker material.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
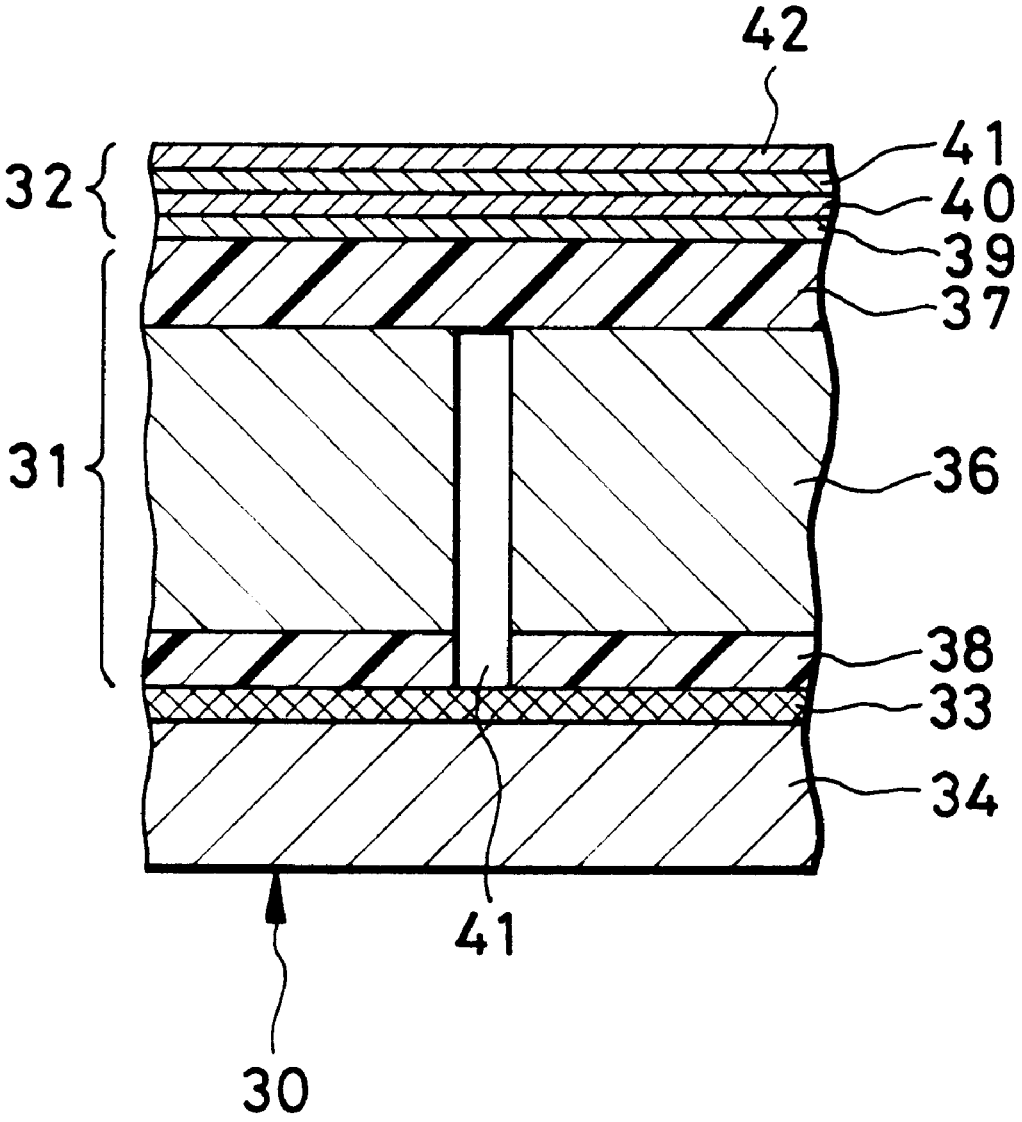
FIG. 1 is a section, partially broken, illustrating a sticker sheet of the present invention.
Figure 10:
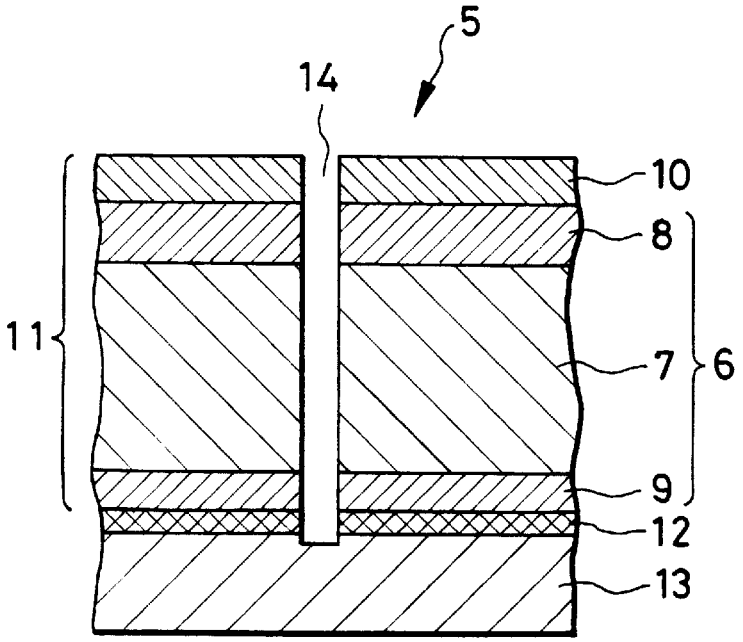
FIG. 10 (PRIOR ART)
FIG. 10 is a section, partially broken, illustrating a sticker sheet of the prior art.

FIG. 1 illustrates a sticker sheet 30 consisting of color thermosensitive recording material. The sticker sheet 30 has a layered structure the same as a sticker sheet 5 of FIG. 10 according to the prior art. The sticker sheet 30 is a material which includes a support 31, thermosensitive coloring layers 32, an adhesive layer 33 and release paper 34. The coloring layers 32 are overlaid on one another on the support 31. The adhesive layer 33 and the release paper 34 are disposed on a reverse face of the support 31. Note that the adhesive layer 33 has a sticky characteristic not hardened in the room temperature.

The support 31 is constituted by support paper 36, an obverse laminate layer 37 and a reverse laminate layer 38. The obverse laminate layer 37 is disposed on a first face of the support paper 36. The reverse laminate layer 38 is disposed on the remaining face of the support paper 36. The laminate layers 37 and 38 are formed from thermoplastic resin. The coloring layers 32 are a cyan coloring layer 39, a magenta coloring layer 40, a yellow coloring layer 41 and a transparent protective layer 42. The coloring layers 32, according to the closeness to the obverse face or recording surface, have higher conductivity of heat, and thus higher sensitivity to heat, and are colorable even with smaller heat energy. Note that it is possible to use a set of coloring layers of which an order of the colors is changed.

The term "sticker material" or "sticker sheet" is herein used to represent a sheet material which has a recording surface and a back surface, and in which the recording surface is adapted to record an image according to image data of an object being picked up, and the back surface is provided with adhesive agent for the purpose of easily enjoying the digital hard copy of the image. A term "recording medium" is herein used to represent a portion of thermal recording sheet without considering an adhesive portion of the sticker sheet.

Cut lines 44 are formed to partition the recording medium into sticker chips. The cut lines 44 are formed only in the support paper 36 and the reverse laminate layer 38, and do not penetrate the coloring layers of the prior example of FIG. 10.

Figure 2:
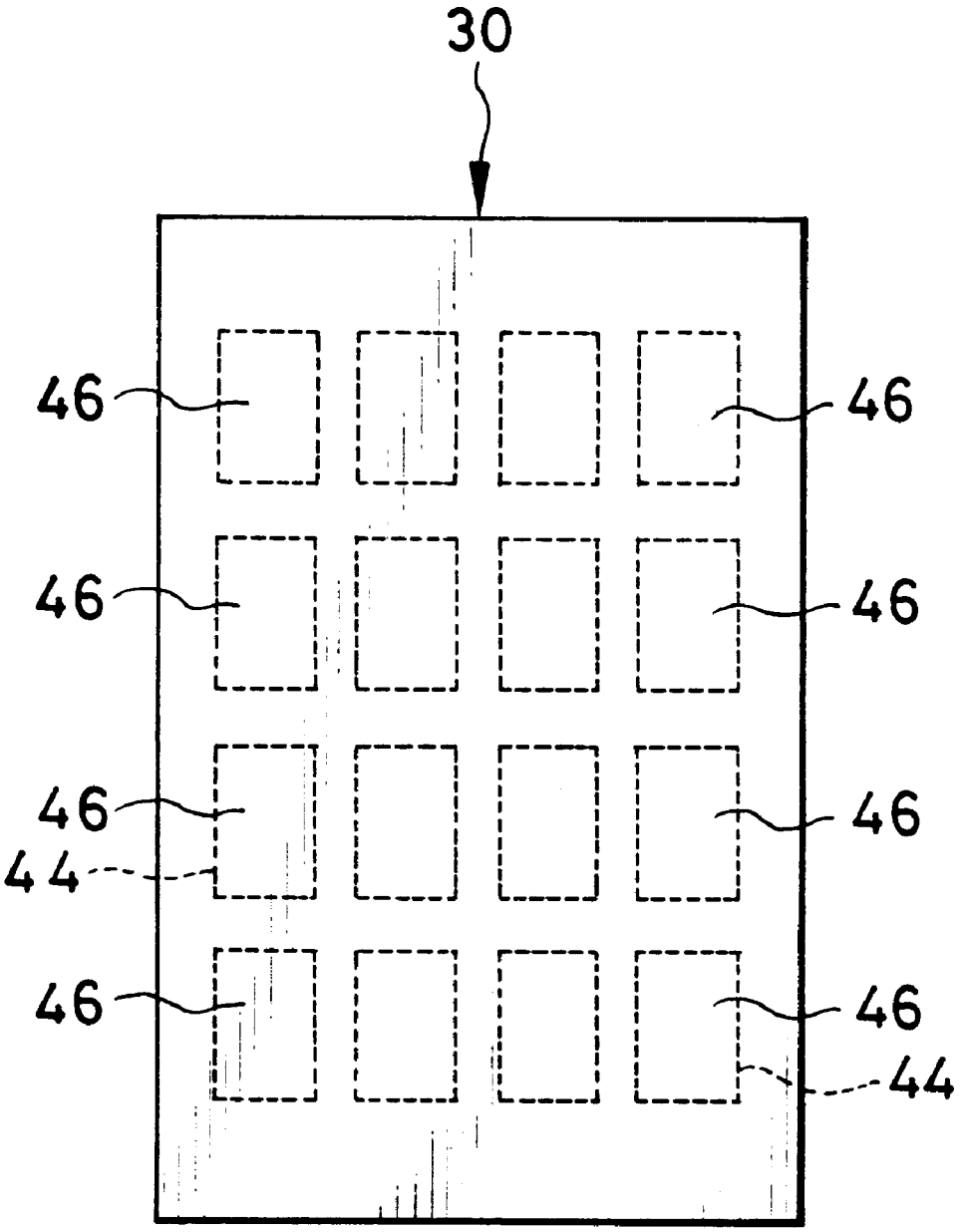
FIG. 2 is an explanatory view in plan, illustrating the sticker sheet.

In FIG. 2, the sticker sheet 30 is partitioned by the cut lines 44 each having a rectangular shape, to define sticker chips 46, which are arranged in a 4×4 matrix as printing sticker chips. The cut lines 44 are covered by the obverse laminate layer 37 and the coloring layers 32. This is effective in keeping rigidity of the positions of the cut lines 44 without being lowered, and keeping the sticker chips 46 from being peeled in the course of printing.

Figure 3:
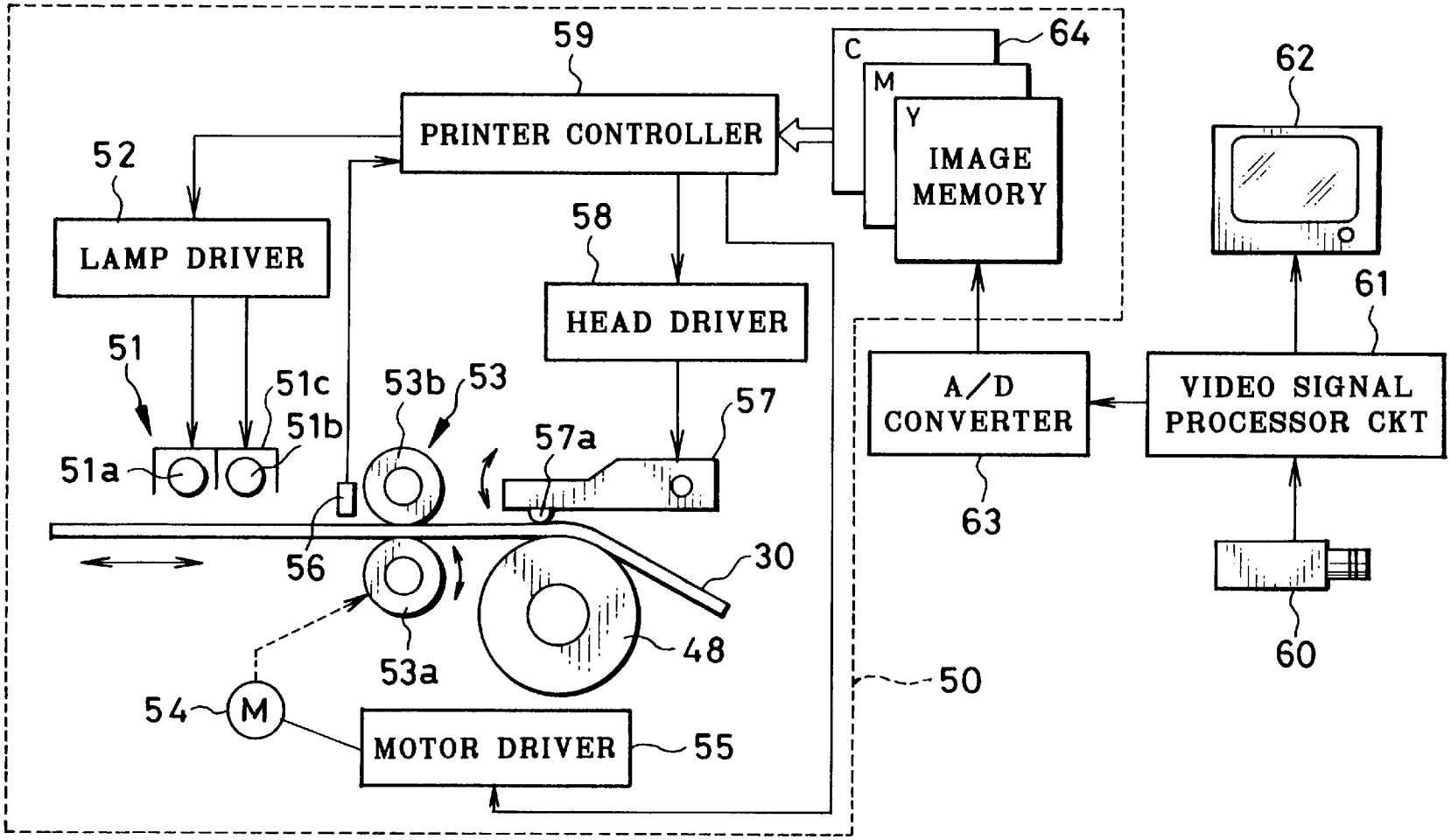
FIG. 3 is a schematic diagram illustrating an image pick-up/printing device or automatic portrait producing machine.

FIG. 3 illustrates an image pick-up/printing device which is an automatic portrait producing machine, and incorporates a color thermal printer. A printer body 50 includes an optical fixer 51. The fixer 51 includes tube-shaped ultraviolet lamps 51*a* and 51*b* and a reflector 51*c*. The yellow fixing ultraviolet lamp 51*a* emits ultraviolet rays having a wavelength range which peaks at about 420 nm for fixation of the yellow color. The magenta fixing ultraviolet lamp 51*b* emits ultraviolet rays having a wavelength range which peaks at about 356 nm for fixation of the magenta color. A lamp driver 52 controls operation of the ultraviolet lamps 51*a* and 51*b*.

A pair of conveyor rollers 53 are a capstan roller 53*a* and a pinch roller 53*b*. The capstan roller 53*a* is driven by a stepping motor 54. The pinch roller 53*b* is driven to rotate by the conveyance of the sticker sheet 30. Rotation of the stepping motor 54 is controlled by a motor driver 55.

The conveyor rollers 53 nip the front end of the sticker sheet 30, before the capstan roller 53*a* is caused by the stepping motor 54 to rotate forwards and in reverse. The sticker sheet 30 is conveyed back and forth along a conveying path. A photo sensor 56 is disposed in front of the conveyor rollers 53 for detecting the front and rear ends of the sticker sheet 30.

A platen roller 48 is disposed beside the conveyor rollers 53 in a free rotatable manner. A thermal head 57 is confronted with the platen roller 48. The thermal head 57 includes heating element array 57*a*, which has a great number of heating elements arranged in line in a main scan direction, namely in the width direction of the sticker sheet 30. Each of the heating elements are driven by a head driver 58.

The thermal head 57 is pivotally movable between a press position and a retreat position. The heating element array 57*a* of the thermal head 57, when in the press position, is pressed against the sticker sheet 30, and when in the retreat position, is moved away from the sticker sheet 30. The thermal head 57 records a one-color image by one line while the sticker sheet 30 is conveyed toward the left in FIG. 3. Conveyance of the sticker sheet 30 back and forth for three times finally records the yellow, magenta and cyan images in a frame-sequential manner.

Image memories 64 store image data of cyan, magenta and yellow colors. A print controller 59 reads the image data of the colors to be recorded from the image memories 64 line by line, and sends the image data to the head driver 58. The print controller 59 controls the lamp driver 52, the motor driver 55 and the head driver 58.

The image pick-up/printing device includes a video camera 60, a video signal processor circuit 61, a display 62 and an A/D converter 63. The video camera 60 picks up an image of an object. The video signal processor circuit 61 processes a video signal from the video camera 60. The display 62 is viewed by a user to monitor a state of being picked up. The A/D converter 63 is connected with the image memories 64. The image pick-up/printing device also includes a mechanism for feeding and exiting recording material (not shown), and a coin saver (not shown).

The operation of the apparatus is described now. For recording of the sticker chips, a client desiring his or her portrait inserts coins into the apparatus at first. Then the client has his or her human face picked up by the video camera 60, and orients it in a suitable position. In the course of positioning the human face, the state of being picked up is monitored in the display 62. A video signal of the human face picked up is sent to the video signal processor circuit 61, covered by the A/D converter 63 into a digital image signal, and then written to the image memories 64 of the yellow, magenta and cyan colors.

A desired one of stored background images is selected, and is combined with a human face image. The combined image is stored in the image memories 64. When a printing command is entered, then image data stored in the image memories 64 is serially sent to the print controller 59 color by color. Printing to the sticker sheet 30 is started.

At first the sticker sheet 30 as a single sheet is supplied by the feeder mechanism (not shown) to advance its rear end. The sticker sheet 30 is conveyed toward the platen roller 48 from the left to the right. When the rear end of the sticker sheet 30 reaches the conveyor rollers 53, the conveyor rollers 53 nip the rear end. The conveyor rollers 53 being rotated in reverse, the sticker sheet is conveyed to the right.

In conveyance of the sticker sheet 30, the front end is detected by the photo sensor 56. Rotation of the conveyor rollers 53 is provisionally stopped, before forward rotation is started. At the same time the thermal head 57 rotates from the retreat position to the press position, to press the heating element array 57*a* against a surface of the sticker sheet 30.

The heating elements of the heating element array 57*a* are driven according to yellow image data included in the object image data stored in the image memories 64, to record a yellow image to the sticker sheet 30. In the sticker sheet 30, the sticker chips 46 are arranged in four lines in the main scan direction and in four columns in the sub scan direction. Thus the yellow recording is effected at four times, to finish the yellow recording to the whole of the sticker sheet 30.

Consequently the yellow image is recorded to each of the sticker chips 46 of the sticker sheet 30. During the yellow recording, the yellow fixing ultraviolet lamp 51*a* is turned on. The yellow coloring layer 41 is optically fixed in the sticker sheet 30.

When the yellow recording and fixation are finished, the conveyor rollers 53 rotate in reverse to convey the sticker sheet 30 back to the right. When the front end of the sticker sheet 30 is detected by the photo sensor 56, the conveyor rollers 53 rotate forwards again, so that the sticker sheet 30 is conveyed to the left. During this conveyance the magenta color is recorded to each of the sixteen sticker chips 46 formed in the sticker sheet 30, in the manner similar to the above-described yellow recording.

During the magenta recording, the magenta fixing ultraviolet lamp 51*b* is turned on, to apply magenta fixing ultraviolet rays to the sticker sheet 30 to fix the magenta coloring layer 40. After the magenta fixation, the sticker sheet 30 is conveyed back, and then conveyed to the left again. During the conveyance the cyan image is recorded to each of the sticker chips 46.

Upon the finish of the cyan recording, a full-color image is thermally recorded to the sticker chips 46 in the sticker sheet 30. The sticker sheet 30 is conveyed further toward the left, and exited through an exit slot (not shown). The sticker chips 46 in the sticker sheet 30 can be torn along the cut lines 44 and peeled from the release paper 34, to be attached to a notebook, a card, or any suitable media to be preserved.

The sticker material is the sheet, but can be naturally continuous sheet of a roll. The continuous sheet is unwound from the roll, and subjected to printing of an image to the sixteen sticker chips in the manner the same as above. After the printing, the continuous sheet is cut by a cutter, to obtain a single sticker sheet, which is ejected.

The heat energy transmitted by the heating element array to the sticker sheet is changed according to contact pressure between them. Coloring density increases if the contact pressure increases. As the heating element array ordinarily has a position offset from the center of the platen roller, the contact pressure changes according to rigidity of the sticker sheet.

In the sticker sheet of the prior art, the cut lines are deep through the coloring layers to extend to the adhesive layer. The recording material included in this is likely to flex in such a manner that edges of the cut lines open in a V-shape. Thus the rigidity of the recording material is not continuous, to cause irregularities in printing density in the course of printing. In contrast the sticker sheet 30 of the present embodiment has the cut lines 44 formed only in the support paper 36 and in the reverse laminate layer 38. The obverse laminate layer 37 and the coloring layers 32 remain uncut. So there is smaller discontinuity in the rigidity, and greater resistance to flexing. It is possible to prevent occurrence of irregularities in the density due to changes in pressing force of the heating element array 57*a*.

Figure 4A:
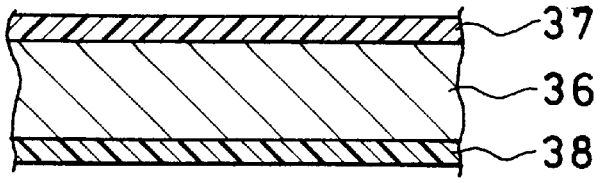
FIG. 4A is an explanatory view in section, illustrating a first step of a sticker producing method, in which a recording medium is placed.

A method of producing the sticker sheet of FIG. 1 is described next, by referring to FIGS. 4A–4E. In FIG. 4A, a station for a first process is illustrated. The laminate layers 37 and 38 are formed on surfaces of the support paper 36 to produce the support 31. The support 31 is referred to as WP paper in the field of paper. This WP paper is used widely as a support of photographic paper and the like.

Figure 4B:
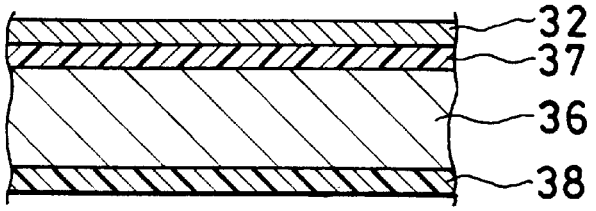
FIG. 4B is an explanatory view in section, illustrating a second step of the method, in which coatings of coloring layers are applied.

In FIG. 4B, a station for a second process is illustrated. The obverse laminate layer 37 of the support 31 is coated with the coloring layers 32. As the coloring layers 32 include three thermosensitive coloring layers, intermediate layers (not shown) and the protective layer 42, a technique of the curtain coating is used to apply multi-coats to the obverse laminate layer 37 of the support 31.

Figure 4C:
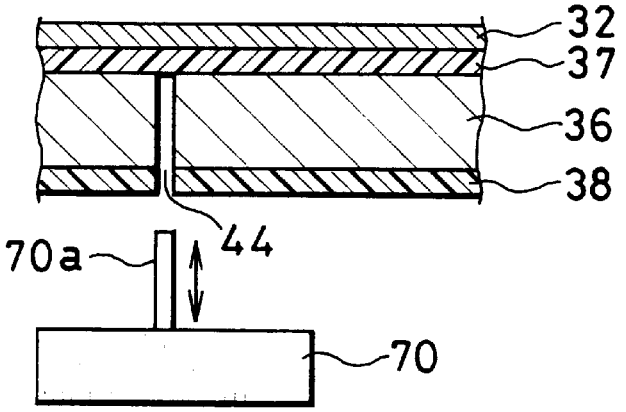
FIG. 4C is an explanatory view in section, illustrating a third step of the method, in which a cutter cuts a cut line.

In FIG. 4C, a station for a third process is illustrated. A press cutter 70 is disposed, and has a cutter blade 70*a,* which cuts the cut lines 44 only in the reverse laminate layer 38 and the support paper 36 in the shapes of the sticker chips 46.

Figure 4D:
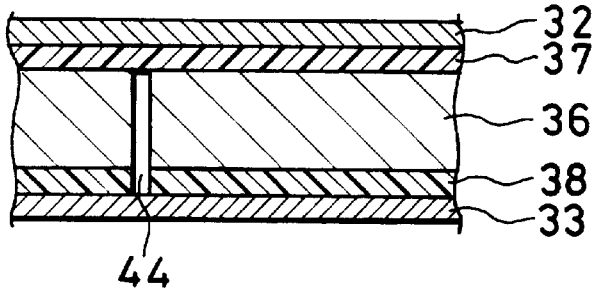
FIG. 4D is an explanatory view in section, illustrating a fourth step of the method, in which a coating of an adhesive layer is applied.
Figure 4E:
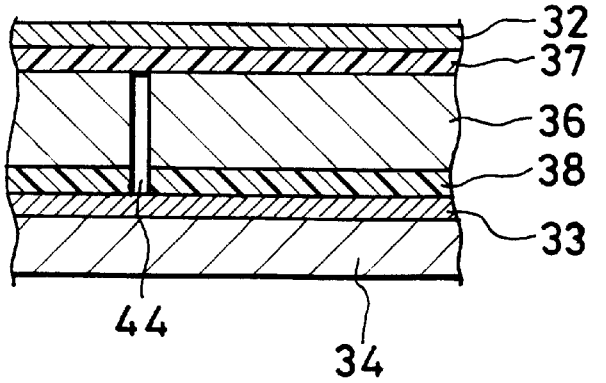
FIG. 4E is an explanatory view in section, illustrating a fifth step of the method, in which release paper is secured.

In FIG. 4D, a station for a fourth process is illustrated. The reverse laminate layer 38 is coated with adhesive agent to form the adhesive layer 33. In FIG. 4E, a final station for a fifth process is illustrated. The release paper 34 is placed on the adhesive layer 33 for adhesion.

Figure 5:
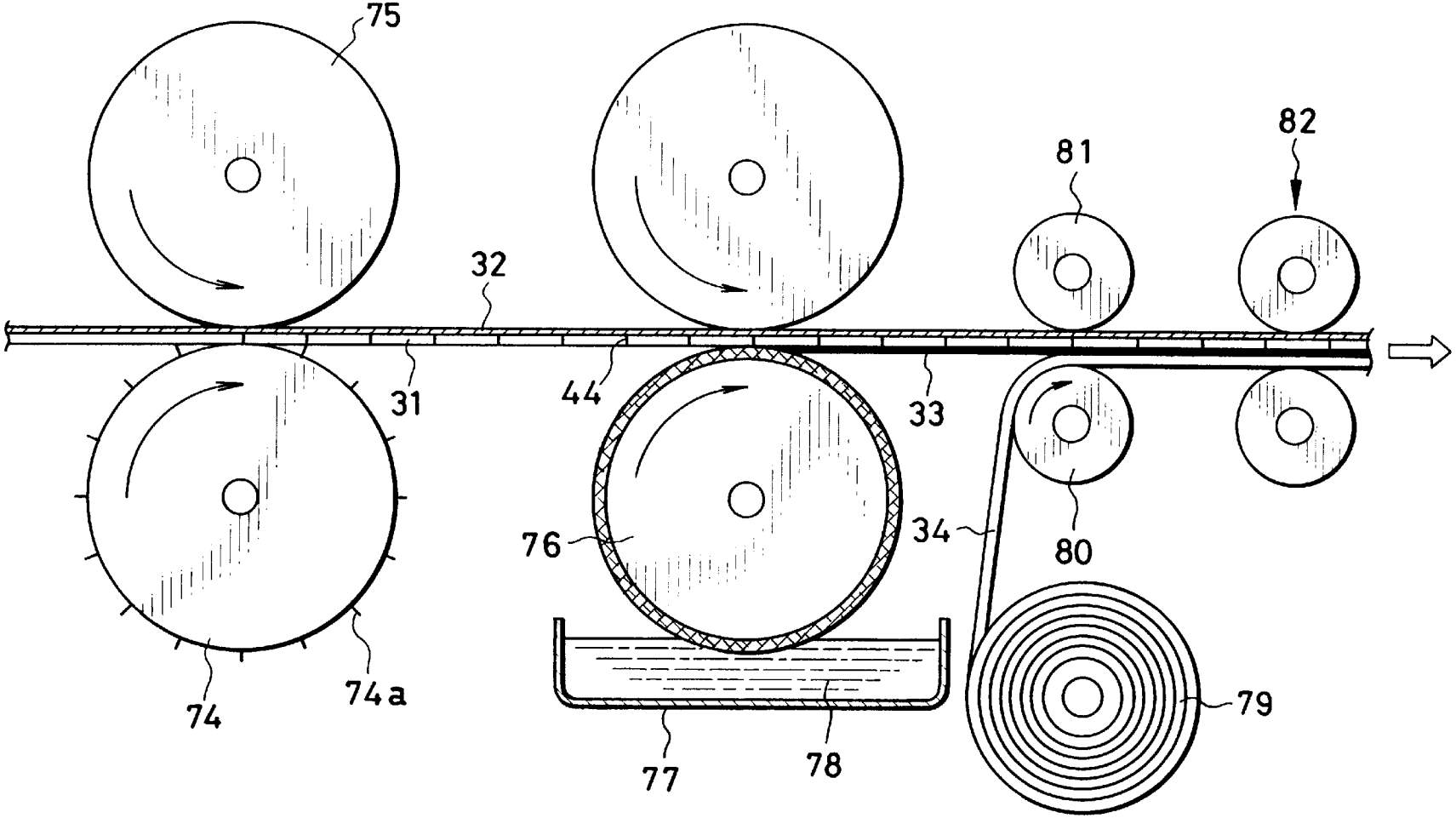
FIG. 5 is an explanatory view in side elevation, illustrating a producing apparatus for the sticker sheet.

FIG. 5 illustrates a producing line for the sticker sheet. A producing line for the color thermosensitive recording material forms the coloring layers 32 on the support 31 having a continuous form. The continuous color thermosensitive recording material is passed between a press; cutter roller 74 and a back-up roller 75. There are blades 74*a* arranged around the press cutter roller 74 in the shapes of the contour of the sticker chips, for forming the cut lines 44 in the back surface of the recording material.

A gravure roller 76 of a gravure coater is used next, to coat the reverse face of the support 31 with adhesive agent 78 which is supplied from a container 77. After the application of the adhesive agent 78, the release paper 34 being continuous is unwound from a release paper roll 79, and is pressed against the adhesive layer 33 by rollers 80 and 81. Note that conveyor rollers 82 are conveying the support 31. In this producing line, the sticker sheet 30 can be produced with high efficiency.

To produce sticker sheets as cut sheets of a predetermined size, a cutter is disposed downstream from the conveyor rollers, and cuts the continuous sheet at the size inclusive of the predetermined number of the sticker chips. Then plural cut sheets of the predetermined number are overlaid on one another, contained in a light-shielded bag, and then wrapped with a packaging material as a package of sticker sheets. If a roll of continuous sticker sheet is to be produced, the continuous sheet is wound on a core, contained in a light-shielded bag, and then wrapped with a packaging material.

In the present embodiment the obverse laminate layer does not have cut lines. It is less easy to peel the sticker chips 46 than that according to the prior art. However it is effective to form the obverse laminate layer from substance which is foamed and thermally broken along the cut lines in the course of the recording of the final color. The color thermosensitive recording material includes the cyan, magenta and yellow coloring layers, which have lower sensitivity to heat in sequence according to the depth of their positions, to require high heat energy to be colored. Thus it is preferable that the obverse laminate layer 37 is melted during the cyan recording requiring the highest heat energy. The obverse laminate layer 37 is formed from substance in which moisture included in it is boiled upon the melting, to create vapor and foams.

Figure 6:
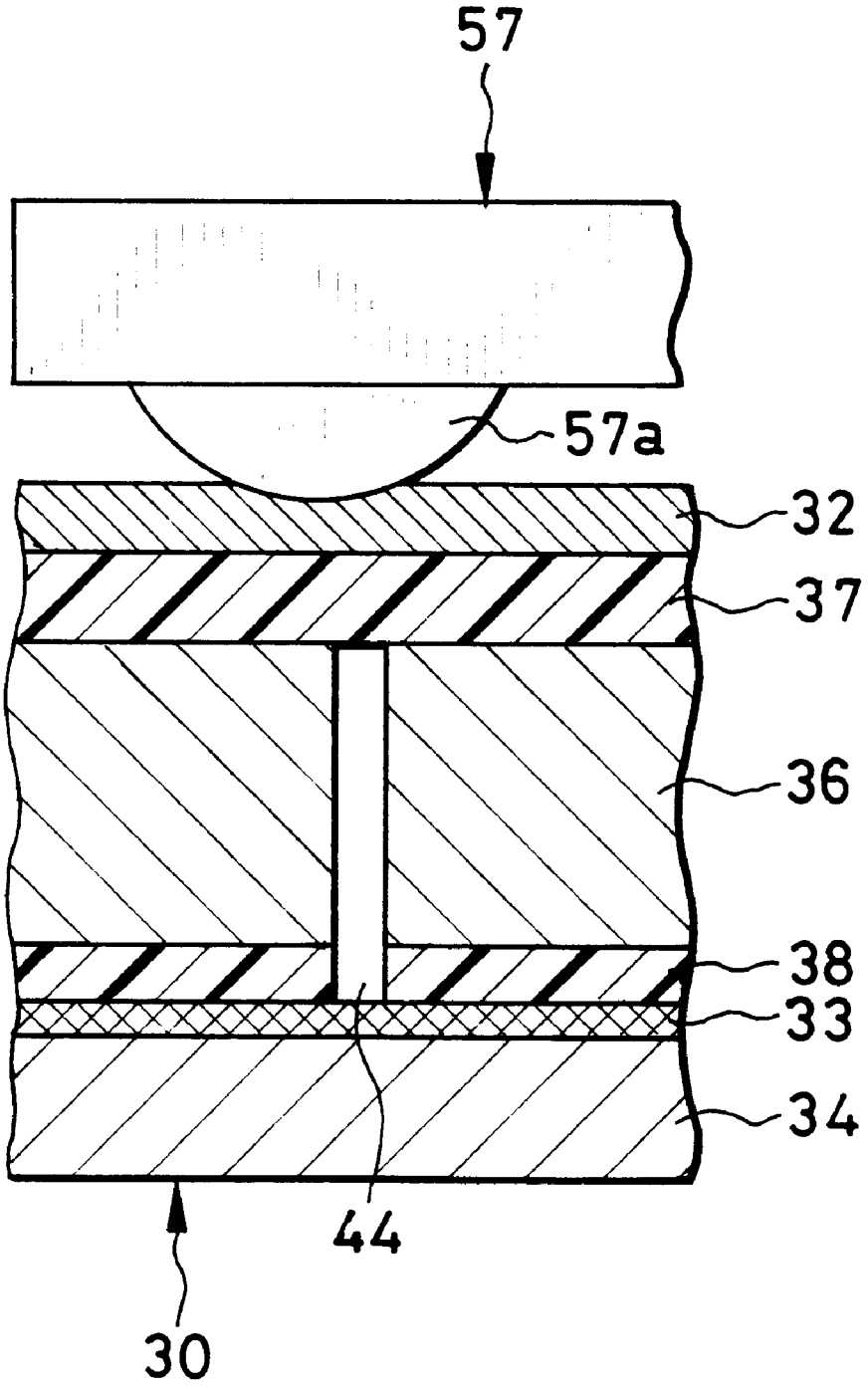
FIG. 6 is an explanatory view in section, illustrating a recording head of the image pick-up/printing device with the sticker sheet.
Figure 7:
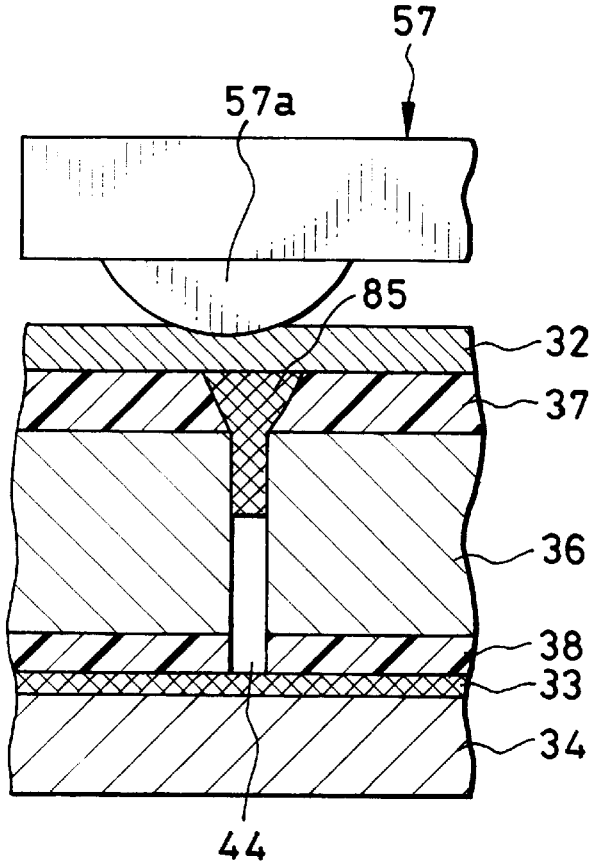
FIG. 7 is an explanatory view in section, illustrating the same as FIG. 6 but in which a laminate layer is melted.
Figure 8:
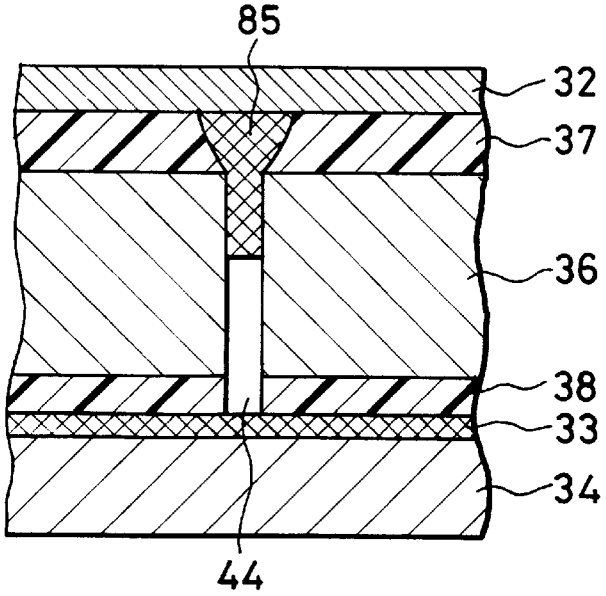
FIG. 8 is an explanatory view in section, illustrating the sticker sheet in which a laminate layer is melted and hardened.

In the thermal recording of the yellow and magenta coloring layers, the obverse laminate layer 37 is not melted or foamed. See FIG. 6. But in the cyan recording, part of the obverse laminate layer 37 in the vicinity of the cut lines 44 is melted and foamed, and enters the cut lines 44 at 85 in FIG. 7. After the thermal recording, a laminate material 85 in the cut lines 44 is hardened as illustrated in FIG. 8. This part of the obverse laminate layer 37 along the cut lines 44 has been thermally destroyed and has a weakened state with foams. Thus the sticker chips 46 can be peeled easily along the positions of the cut lines 44.

The preferable substance for the above-described obverse laminate layer is resin of which viscosity becomes 20,000 poises or less in condition of at least 180° C. which is magenta recording temperature, for example low-density polyethylene having melting point of 110° C. Note that the thermal breakage of the obverse laminate layer is influenced not only by the temperature but by conveying speed of the sticker sheet. There is no thermal breakage in the course of the magenta recording.

Rigidity of the sticker material can be increased by increasing strength of the coloring layers, not only by increasing strength of the obverse laminate layer. Preferable material mainly constituting the coloring layers includes binder of which tensile strength in the condition of room temperature and normal humidity is 5 kg/mm$^2$ or less. A good example of the binder is gelatin.

Figure 9:
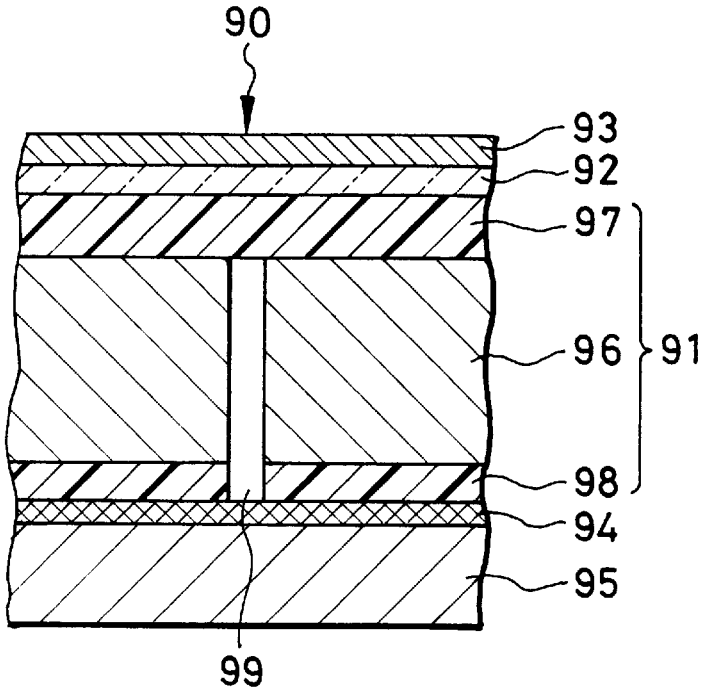
FIG. 9 is a section, partially broken, illustrating another preferred sticker sheet including a thermal transfer printing medium.

FIG. 9 illustrates a sticker sheet 90 consisting of thermal transfer recording material. The sticker sheet 90 includes a support 91, a gelatin layer 92 and a dye receiving layer 93 in sequence. The reverse face of the support 91 is provided with an adhesive layer 94 and release paper 95. The support 91 is constituted by support paper 96, an obverse laminate layer 97 and a reverse laminate layer 98. The obverse laminate layer 97 is formed on one face of the support paper 96. The reverse laminate layer 98 is formed on the remaining face of the support paper 96. The obverse laminate layer 97 and the gelatin layer 92 are arranged to cover cut lines 99, so that the sticker sheet 90 is kept rigid.

Figure 11:
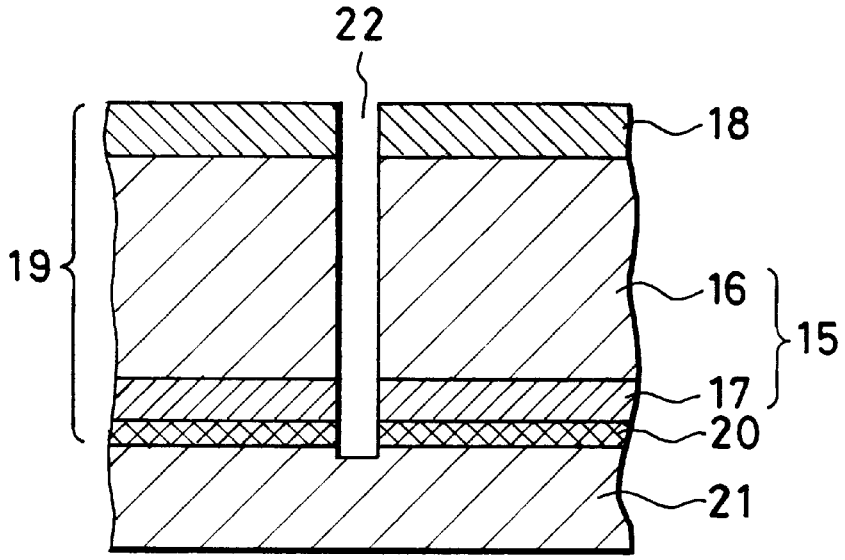
FIG. 11 (PRIOR ART)
FIG. 11 is a section, partially broken, illustrating another sticker sheet of the prior art.
Figure 12:
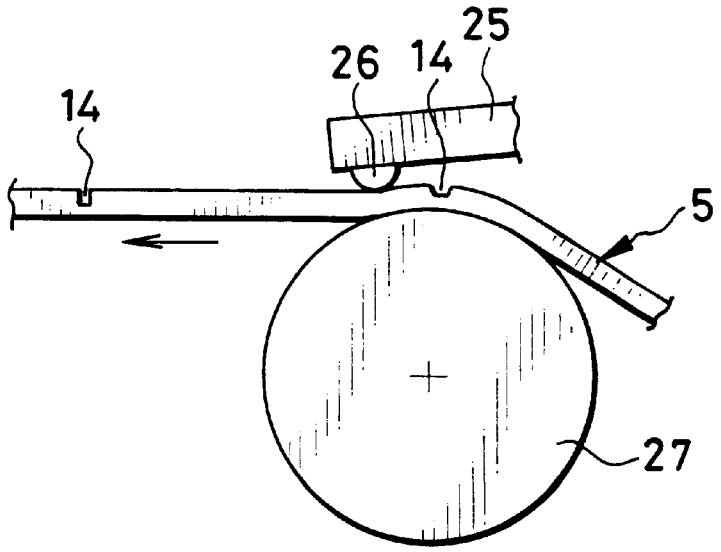
FIG. 12 (PRIOR ART)
FIG. 12 is an explanatory view in side elevation, illustrating an image pick-up/printing device with the sticker sheet of the prior art.
Figure 13:
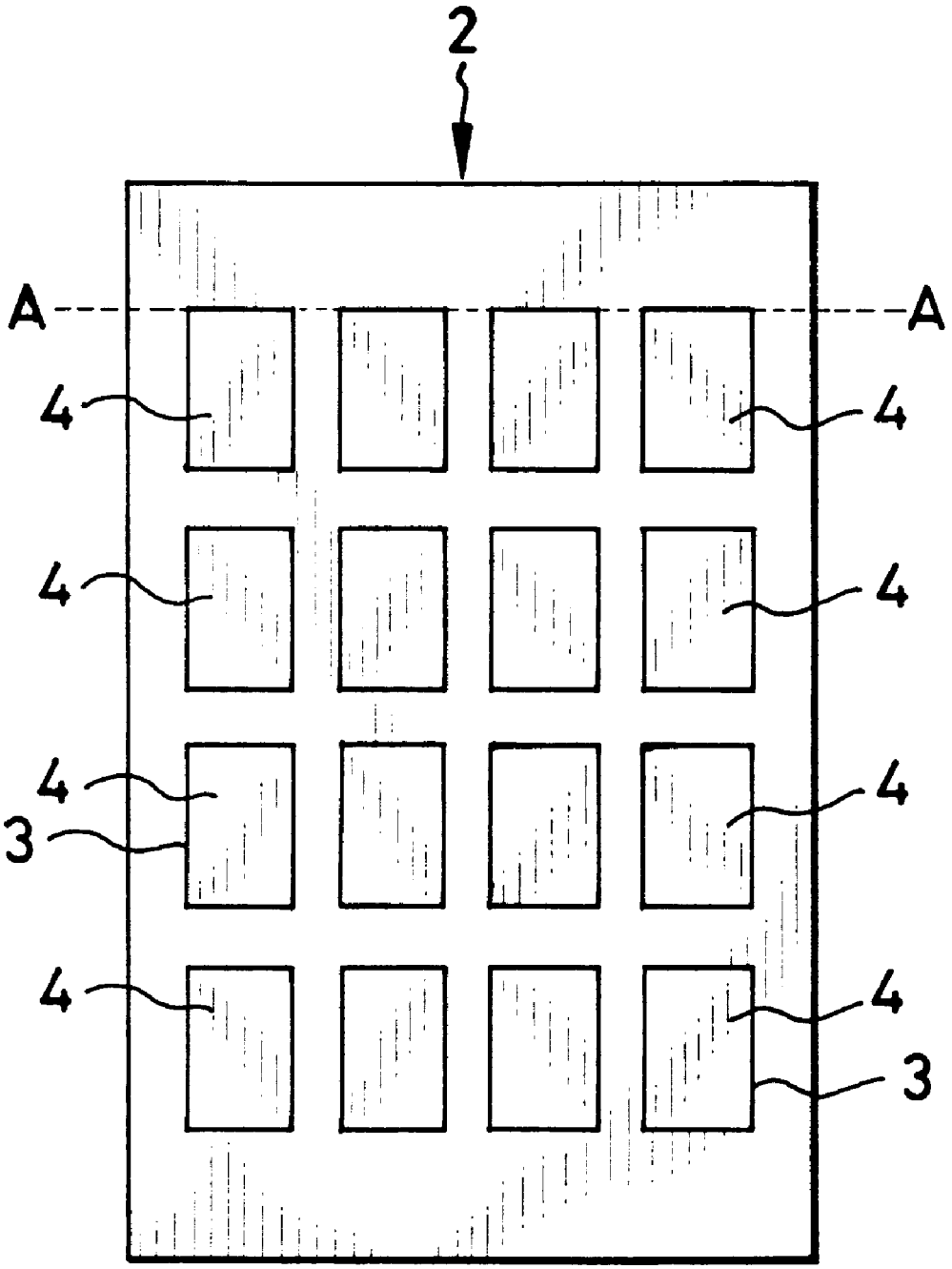
FIG. 13 (PRIOR ART)
FIG. 13 is an explanatory view in plan, illustrating the sticker sheet of the prior art.

The cut lines 99 for partitioning of the sticker chips are formed only in the support paper 96 and the reverse laminate layer 98, and not through the dye receiving layer and the adhesive layer. This is unlike the case of the prior art of FIG. 11.

In production of the sticker sheet 90, the dye receiving layer does not lie directly on the support paper 96. This is unlike the case of the prior art. The obverse laminate layer 97 and the gelatin layer 92 are overlaid on the face of the support paper 96 to increase the rigidity, before the dye receiving layer 93 is overlaid on the gelatin layer 92. The recording material, being produced as a half-finished product, is subjected to the third, fourth and fifth processes including cutting and adhesion of the release paper. Also the producing line in FIG. 5 can be used for adhesion of the adhesive layer 94 and the release paper 95 with high efficiency.

In the sublimation type of thermal transfer recording method, three kinds of ink ribbon or ink sheets are used to transfer ink dots to the dye receiving layer by use of heat energy of ranges which are equal to one another between the three colors. It is further preferable to predetermine the thermal transfer temperature higher for the final kind of the color ink ribbon or color ink sheets than for the remaining kinds of them. So the rigidity of the recording medium can be kept high in the course of the printing. Seal printing chips can be easily peeled after the printing operation.

In the above embodiments, the cut lines are so formed that their bottoms are located in the position between the support paper 36, 96 and the obverse laminate layer 37, 97. But only part of the obverse laminate layer 37, 97 with a small thickness may be cut, to locate the bottoms of the cut lines in the middle of the obverse laminate layer 37, 97.

In the above embodiments, the recording medium is the direct thermal recording sheet or the thermal transfer recording sheet. Alternatively instant photo film may be used as recording medium in the present invention. An obverse and a reverse laminate layers are disposed on respectively surfaces of the photo film support. At least one photosensitive emulsion layer is disposed on the obverse laminate layer, for constituting a photosensitive material with the photo film support.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A sticker material comprising:

support paper;

an obverse laminate layer and a reverse laminate layer disposed on opposite surfaces of said support paper respectively, wherein said obverse laminate layer, said reverve laminate layer and said support paper form a support;

at least one thermosensitive coloring layer disposed on said obverse laminate layer, wherein said thermosensitive coloring layer and said support form a recording medium;

an adhesive layer disposed on said reverse laminate layer;

a release paper secured to said adhesive layer in a peelable manner; and a cut line, formed in said reverse laminate layer and said support paper, for partitioning said recording medium into a plurality of sticker chips, wherein after thermal recording, said coloring layer and said obverse laminate layer are tearable along said cut line, and said sticker chips are peelable with said adhesive layer from said release paper.

2. A sticker material as defined in claim 1, wherein said sticker chips are substantially rectangular, and arranged in a matrix in said recording medium.

3. A sticker material as defined in claim 1, wherein said at least one coloring layer comprises a plurality of thermosensitive coloring layers overlaid on one another, said coloring layers sequentially decreasing in heat sensitivity toward said support, and being supplied serially with first to Nth heat energy, for said thermal recording in a frame-sequential manner layer after layer toward said support;

part of said obverse laminate layer along said cut line is broken by said Nth heat energy.

4. A sticker material as defined in claim 3, wherein said obverse laminate layer is formed of thermoplastic resin.

5. A sticker material as defined in claim 4, wherein said thermoplastic resin comprises low-density polyethylene.

6. A sticker material comprising:

support paper;

an obverse laminate layer and a reverse laminate layer disposed on opposite surfaces of said support paper respectively, wherein said obverse laminate layer, said reverve laminate layer and said support paper form a support;

a dye receiving layer disposed on said obverse laminate layer, wherein said dye receiving layer and said support form a recording medium;

an adhesive layer disposed on said reverse laminate layer;

release paper secured to said adhesive layer in a peelable manner; and a cut line, formed in said reverse laminate layer and said support paper, for partitioning said recording medium into a plurality of sticker chips, wherein after thermal transfer recording, said dye receiving layer and said obverse laminate layer are tearable along said cut line, and said sticker chips are peelable with said adhesive layer from said release paper.

7. A sticker material as defined in claim 6, further comprising a gelatin layer disposed between said obverse laminate layer and said dye receiving layer.

8. A sticker material as defined in claim 6, wherein said sticker chips are substantially rectangular, and arranged in a matrix in said recording medium.

9. A sticker material as defined in claim 8, wherein said obverse laminate layer is formed of thermoplastic resin.

10. A sticker material as defined in claim 9, wherein said thermoplastic resin comprises low-density polyethylene.

11. A sticker producing method comprising steps of:

coating top and bottom surfaces of a support paper with an obverse laminate layer and a reverse laminate layer respectively, to form a support;

coating said obverse laminate layer of said support with at least one thermosensitive coloring layer or a dye receiving layer, to form a recording medium;

forming a cut line by cutting said reverse laminate layer and said support paper, for partitioning said recording medium into a plurality of sticker chips;

coating said reverse laminate layer with an adhesive layer; and securing release paper to said adhesive layer in a peelable manner.

12. A sticker producing method as defined in claim 11, wherein said at least one coloring layer comprises a plurality of thermosensitive coloring layers overlaid on one another, said coloring layers decreasing in heat sensitivity in sequence toward said support, and being supplied serially with first to Nth heat energy, for said thermal recording in a frame-sequential manner layer after layer toward said support;

part of said obverse laminate layer along said cut line is broken by said Nth heat energy, said coloring layer and said obverse laminate layer are tearable along said cut line, and said sticker chips are peelable with said adhesive layer from said release paper.

13. A sticker printing method for use with a sticker material, said sticker material comprising a support including a support paper and an obverse laminate layer and a reverse laminate layer disposed on opposite surfaces of said support paper respectively, N coloring layers overlaid on one another and disposed on said obverse laminate layer for forming a recording medium with said support, said coloring layers having heat sensitivity decreasing in sequence toward said support, an adhesive layer disposed on said reverse laminate layer, and a release paper secured to said adhesive layer in a peelable manner, wherein before disposing said adhesive layer, said reverse laminate layer and said support paper are cut along a cut line, said cut line partitioning said recording medium into a plurality of sticker chips, said sticker printing method comprising a step of:

supplying said recording medium serially with first to Nth heat energy, for thermal recording of said coloring layers in a frame-sequential manner one after another, wherein said Nth coloring layer is colored by said Nth heat energy, part of said obverse laminate layer along said cut line is broken by said Nth heat energy, and said coloring layers and said obverse laminate layer are tearable along said cut line, and said sticker chips are peelable with said adhesive layer from said release paper.

* * * * *